United States Patent [19]

Adams et al.

[11] Patent Number: 4,581,901

[45] Date of Patent: Apr. 15, 1986

[54] CONTROL SYSTEM FOR A HEAT PUMP SYSTEM

[75] Inventors: George W. Adams, Greenwood; Jimmy L. Sheeks, Indianapolis, both of Ind.

[73] Assignee: Emhart Industries, Inc., Indianapolis, Ind.

[21] Appl. No.: 628,156

[22] Filed: Jul. 5, 1984

Related U.S. Application Data

[63] Continuation-in-part of Ser. No. 459,813, Jan. 21, 1983, abandoned.

[51] Int. Cl.[4] ..... F25D 21/08; H01H 7/08

[52] U.S. Cl. ..... 62/234; 200/38 D

[58] Field of Search ..... 62/155, 234, 161, 157; 200/38 R, 38 A, 38 BA, 38 B, 38 D, 38 DC

[56] References Cited

U.S. PATENT DOCUMENTS

| | | | |
|---|---|---|---|
| 3,333,121 | 7/1967 | Ross | 200/38 R X |
| 3,610,848 | 10/1971 | Rosenberg | 200/38 B |
| 4,123,915 | 11/1978 | Stoor | 62/234 |

*Primary Examiner*—Harry Tanner

*Attorney, Agent, or Firm*—Robert F. Meyer

[57] ABSTRACT

A control system provides slow and fast defrost cycles for a heat pump by providing an auxiliary manual switch to select different cams of a timing means for cycle operation. Selective ones of the cam switches are connected in parallel to permit two different defrost time cycles utilizing four cams rotating at the same speed.

2 Claims, 2 Drawing Figures

CONTROL SYSTEM FOR A HEAT PUMP SYSTEM

This is a continuation-in-part of application Ser. No. 459,813, filed Jan. 21, 1983, now abandoned.

BACKGROUND OF THE INVENTION

Generally speaking, the present invention pertains to a defrost control system which comprises a timing means including a power driven cam means and electrical switch means opening and closing in response to the cam means and electrically coupled to a heat pump system, and manual switch means electrically connected to selected ones of the electrical switch means.

The present invention pertains to a defrost control system for a heat pump and more particularly to such a system that has a fast defrost cycle and a slow defrost cycle.

Heat pumps have been increasingly used in recent years in heating and cooling of buildings. In the use of such systems, it has been found that during the winter months of operation a heat pump will ice up. The amount of ice that builds up on the evaporator coils will depend on the ambient temperature, relative humidity and wind velocity. These conditions will vary in different parts of the country and even in different locations around the same building. Therefore, it is difficult to determine in advance a proper defrost cycle. The present invention overcomes this problem by providing a means wherein a desired defrost cycle can be selected very easily by the manufacturer, service man or the building owner.

OBJECTS OR FEATURES OF THE INVENTION

It is, therefore, a feature of the present invention to provide a defrost control system which provides fast and slow defrost cycles. Another feature of the invention is to provide such a system wherein a timing means has predetermined fast and slow cycles and wherein a selector means permits one of the cycles to be selected. Another feature of the invention is to provide such a system wherein the selector means includes a manual selector switch. Still another feature of the invention is to provide such a system wherein the manual selector switch selectively provides parallel connections between selected ones of cam operated electrical switch means. These and other features of the invention will become apparent from the following description taken in conjunction with the accompanying drawings.

DETAILED DESCRIPTION OF THE INVENTION

Figure 1:
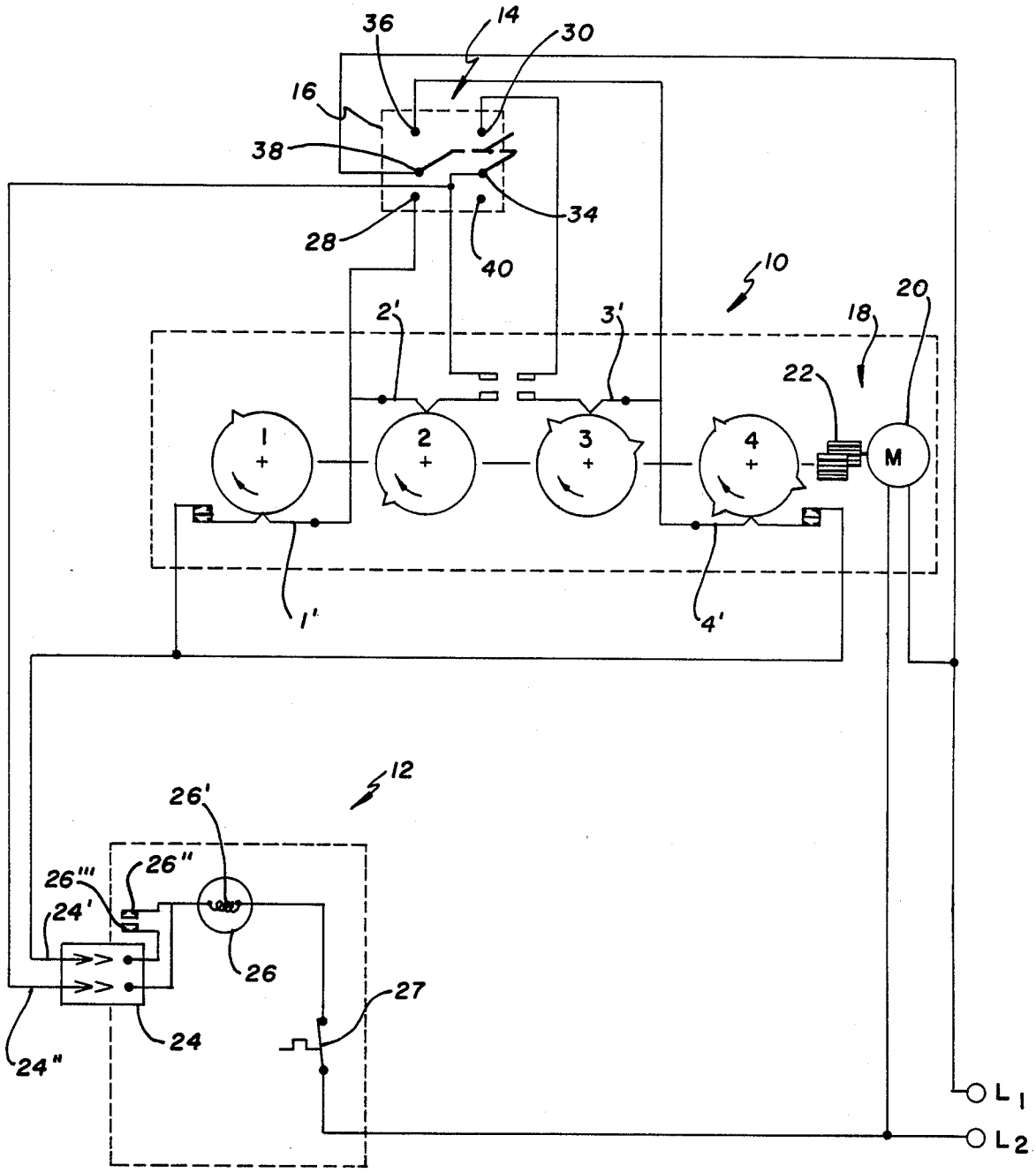
FIG. 1 is a wiring schematic of the control system.

Referring now to the wiring schematic, a defrost control system for a heat pump system 12, in accordance with the invention, includes a timing means 10 and a manually operable selector switch means 14. Manually operable switch means 14 includes a double pole double throw switch 16. Timing means 10 includes cams 1 through 4, switch means 1' through 4' engaging the cams to be opened and closed in accordance with the cam profiles, and motor drive means 18 which applies power driven rotation to the cams. Motor drive means 18 includes a synchronous motor 20 which drives a gear train 22 which is coupled to the cams through a clutch (not shown). Since the heat pump system forms no part of the present invention, only the essential elements are shown which includes electrical input means such as a plug 24, a relay 26 having a holding coil 26', electrical contacts 26'' and 26''' and a thermostat control 27. Inputs 24'' and 24''' are connected to electrical contacts 26'' and 26''' of relay 26.

As shown, switch means 1' is connected between a side 24' of input 24 and a terminal 28 of the manual switch. Switch means 2' is connected between terminal 28 and terminal 34 of the manual switch. Switch means 3' is connected between terminal 30 of the manual switch means and switch means 4'. Switch means 4' is connected between terminal 36 and side 24' of plug 24 and in combination with holding coil 26' provides a holding circuit through relay contacts 26'' and 26'''. Synchronous motor 20 is connected between L1 and L2. Terminal 38 of the manual switch means is connected to L1 and terminal 34 is connected to another side 24'' of plug 24 which initiates a defrost holding circuit. Relay 26 is connected to L2 through thermostat 27. Terminal 40 of the double pole double throw switch is not used.

In the present embodiment, cams 1 and 2 and their attendant switches 1' and 2' which are in parallel, provide a "slow" defrost cycle. Cams 1–4 with their attendant switches 1'–4' provide a "fast" defrost cycle. Switches 3' and 4' are in parallel, while switch 2' is in parallel with switches 3' and 4' and switch 1' is in series with 4'. These parallel connections permit two different defrost cycles utilizing four cams rotating at the same speed. This system provides a safety feature insuring positive termination of the defrost cycle. Manual switch 14 permits the manufacturer or service man to select a desired defrost cycle. Terminals 36 and 30 provide a fast cycle (for example 30 minutes) while terminal 28 provides the slow cycle (for example, 90 minutes). The speed ratio would, therefore, be 3 to 1 and will always be repeated since the cams are permanently synchronized.

Figure 2:
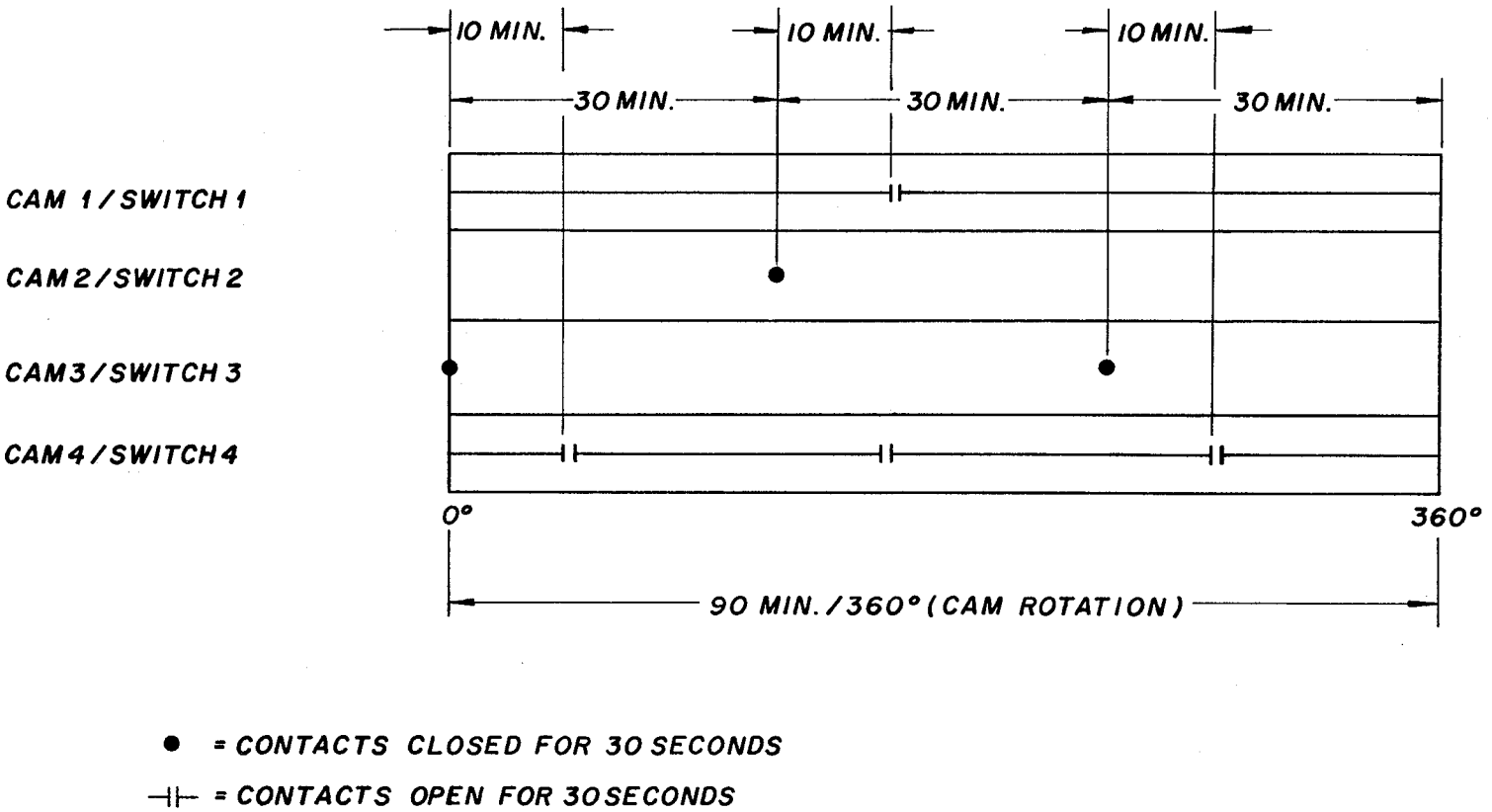
FIG. 2 is a time chart showing cycle times of the control system.

In operation, assume that a fast (30 minutes) defrost cycle of the heat pump system as been manually set. The defrosting of the heat pump coil is jointly controlled by the timing means 10 and thermostat control 27. Referring to FIGS. 1 and 2, with manual switch 14 closing terminals 36 and 30, cams 2 and 3 close switches 2' and 3', which are in parallel, for a period of 30 seconds. Switches 1' and 4' are closed. If at this time thermostat 27, which senses the temperature of the coil of the heat pump system, senses a predetermined temperature (44° F., for example) or below, its contacts are also closed. The closing of switches 2' or 3' and the closing of the thermostat contacts completes the circuit and energizes relay 26 to initiate a defrost cycle. Upon energizing relay 26, normally open contacts 26'' and 26''' are closed to complete a circuit through holding coil 26' of relay 26 when switch 4' is closed to latch the circuit in a defrost cycle. When the heat pump is stopped, the flow of hot gas through the heat pump raises its temperature, melting the frost of the heat pump coil until its temperature reaches a predetermined temperature (67° F.) at which time thermostat 27 opens to deenergize holding coil 26' of relay 26. If thermostat 27 fails to open due to adverse weather conditions, switch 4', controlled by cam 4, will momentarily open to deenergize holding coil 26' of relay 26. This provides a safety feature insuring that the defrost cycle is terminated. Either condition terminates the defrost cycle and returns the system to a heating mode of operation.

With the manual switch 14 closed between terminals 28 and 38, the defrost cycle is set for a slow cycle (90 minutes) and timing means 10 closes switch 2' by cam 2 for a period of 30 seconds every 90 minutes. Switch 2' is in parallel with switch 1'. Switch 1' opens by cam 1 for 30 seconds every 90 minutes, 10 minutes after switch 2' closes by cam 2. Holding coil 26' of relay 26 closes the relay contacts 26'' and 26''' and defrost takes place as previously described with respect to the fast cycle, all other switching sequences and operational modes of the defrost system being identical.

What is claimed is:

1. A defrost control system providing first and second defrost cycles wherein a timing means includes power driven cam means and first, second, third and fourth electrical switches opening and closing in response to said cam means, said first and fourth electrical switches adapted to be selectively electrically coupled to a relay and a temperature control means of a heat pump, and a manual selector switch adapted to be electrically coupled to selected ones of said first, second, third and fourth electrical switches, and wherein said first and second defrost cycles are selectively provided as follows:

for said first defrost cycle, said manual selector switch positioned to provide a parallel connection between said second and third electrical switches with said second switch being in series with said first and fourth switches; said first and fourth switches electrically coupled to said relay and said temperature control means, for said second defrost cycle, said manual switch positioned to provide a parallel connection between said first and second switches; said first switch electrically coupled to said relay and said temperature control means.

2. A defrost control system according to claim 1 wherein said manual selector switch means is a double pole double throw switch.

* * * * *